United States Patent [19]

Kilpatrick

[11] Patent Number: 4,826,338

[45] Date of Patent: May 2, 1989

[54] MULTI-TIP PEN AND HOLDER

[76] Inventor: William Kilpatrick, Miller Hill, Highlands, N.J. 07732

[21] Appl. No.: 11,623

[22] Filed: Feb. 6, 1987

[51] Int. Cl.[4] ..... B43K 27/00; B43K 31/00

[52] U.S. Cl. ..... 401/35; 401/131; 211/69.1; 33/41.4

[58] Field of Search ..... 401/35, 131; 33/41.4, 33/44, 44.1; 211/69.1, 69.5, 69.8, 69.9

[56] References Cited

U.S. PATENT DOCUMENTS

| | | | |
|---|---|---|---|
| 231,703 | 8/1880 | Dredge | 33/41.4 |
| D. 273,395 | 4/1984 | Wilkinson | 401/35 X |
| 428,250 | 5/1890 | Hazen | 401/35 |
| 594,186 | 11/1897 | Walter | 401/35 |
| 1,677,387 | 7/1928 | Gaidos | 401/89 |
| 2,622,560 | 12/1952 | Menaker | 401/88 |
| 3,079,895 | 3/1963 | Gordon | 401/117 |
| 3,164,906 | 1/1965 | Andaloro | 401/28 |
| 3,166,847 | 1/1965 | Marino | 401/88 |
| 4,238,161 | 12/1980 | Morohashi | 401/35 |
| 4,355,726 | 10/1982 | Mutschler | 211/69.5 X |

FOREIGN PATENT DOCUMENTS

| | | | |
|---|---|---|---|
| 332937 | 2/1921 | Fed. Rep. of Germany | 33/41.4 |
| 365198 | 9/1906 | France | 401/35 |
| 2309349 | 11/1976 | France | 33/41.4 |
| 355188 | 2/1930 | United Kingdom | 33/41.4 |

OTHER PUBLICATIONS

Charvoz, "The Unitech Pen," 4-page brochure.

Koh-I-Nor, "Rapidograph Technical Pen," 12-page brochure.

Staedtler, "Mars 700," 6-page brochure.

*Primary Examiner*—Richard J. Apley

*Assistant Examiner*—Franklin L. Gubernick

*Attorney, Agent, or Firm*—Bryan, Cave, McPheeters & McRoberts

[57] ABSTRACT

A multi-tipped pen and a pen/pen holder combination are disclosed. The multi-tipped pen has an even number of pen tips spaced at a set distance to enable to user to draw simultaneously parallel lines. The pen is used by layout artists to indicate the placing and size of printed material that will appear in the final version of an advertisement. The distance between the pen tips indicates the size of type to be used. The pen may be located within a pen holder that prevents the pen tips from drying out.

4 Claims, 2 Drawing Sheets

Fig. 1.
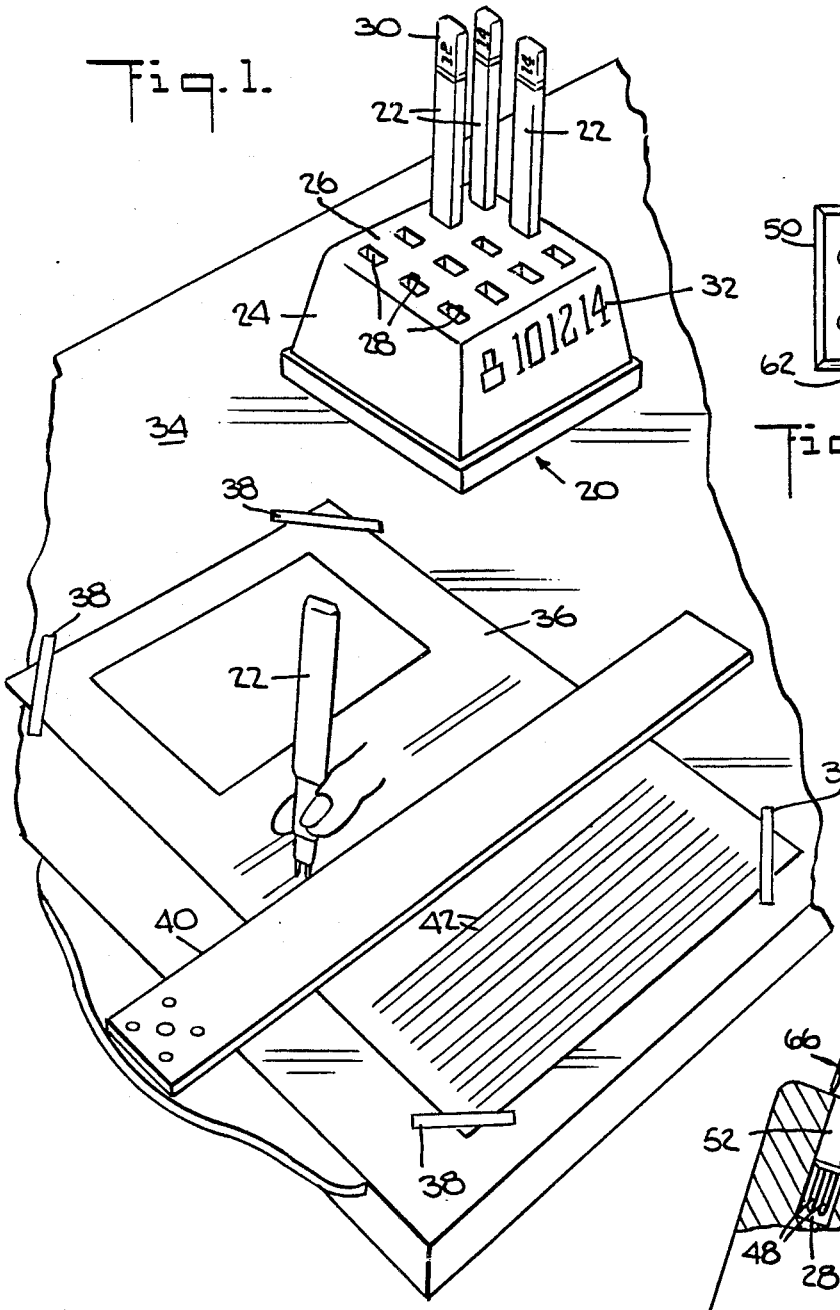
Fig. 4.
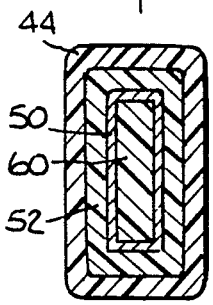
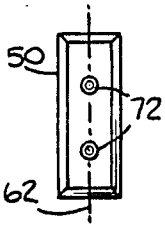
Fig. 5.
Fig. 6.
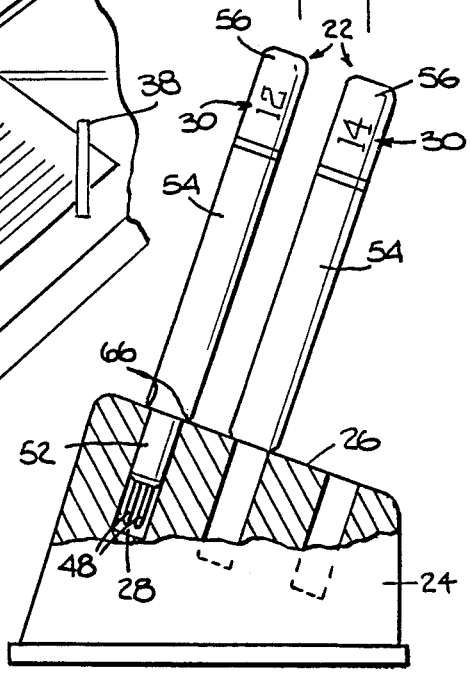
Fig. 2.
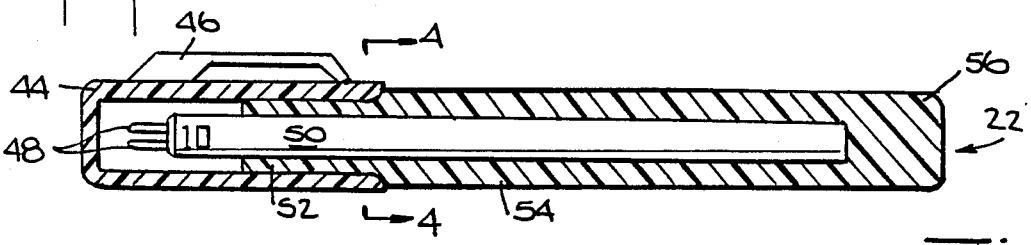
Fig. 3.
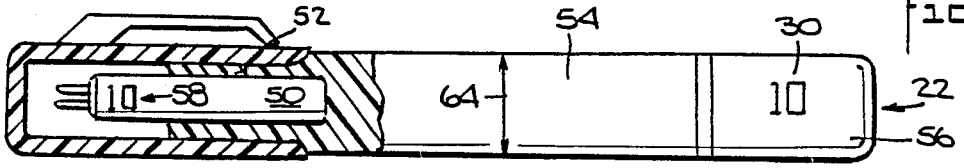

MULTI-TIP PEN AND HOLDER

BACKGROUND OF THE INVENTION

This invention concerns drawing implements for use in preparing layouts for advertising copy. In preparing such documents the size of the printed matter appearing in the final document is customarily indicated on a draft version (layout) of the document by the distance between two parallel lines placed where the printed matter is to appear, a greater distance indicating a larger type font. The customary method for placing these parallel lines on the draft copy is by drawing the lines one at a time using a conventional pen and straightedge. Accordingly, the person preparing the draft document must be exceedingly careful to insure that the lines are properly placed, otherwise the wrong size type font will be used by the typographer. Furthermore, drawing numerous individual lines is time consuming. If a pen that can dry out quickly is used, constant recapping of the pen when not in use is necessary.

U.S. Pat. No. 3,164,906 concerns a pen having one or more sets of five tips for drawing musical staffs. U.S. Pat. No. 3,166,847 concerns a device for drawing faint lines on paper, the lines serving as guides for lettering. U.S. Pat. No. 2,622,560 concerns typing or printing elements, some of which have multiple points for producing parallel lines. U.S. Pat. No. 4,238,161 concerns a device for producing inkspots on a curved surface such as a lens, the device having a plurality of parallel ink-dispensing cylinders. U.S. Pat. No. 1,677,387 concerns a combination pencil container, lead magazine, and scale, which container may have a triangular or hexagonal shape. Brochures from Charvoz, Koh-I-Noor, and Staedtler show pen and holder combinations (Charvoz, "The Unitech Pen," 4-page brochure, last page; Koh-I-Noor, "Rapidograph Technical Pen," 12-page brochure, pages 5 and 6;Staedtler, "Mars 700," 6-page brochure, pages 2 and 3).

SUMMARY OF THE INVENTION

The present invention provides a multi-tipped pen having an even number of pen tips to facilitate drawing the parallel lines required for preparing layouts for advertisements. The distance between the pen tips of a given pen indicates a specific character size in accordance with customary usage. One feature of the pen is that the cross-section of at least part of the pen is substantially rectangular and the major axis of that cross-section is parallel to an imaginary line connecting the ends of the pen tips. That ensures that the person using the pen will hold it in its proper orientation while drawing the parallel lines.

Broadly, the pen comprises:

(a) a casing having a bottom casing section, a middle casing section, and a top casing section, the middle casing section having an approximately rectangular cross-section;

(b) a pen tip mounting section attached to the casing; and (c) an even number of pen tips in spaced relationship attached to the pen tip mounting section and extending outward from the casing, the ends of the pen tips lying on an imaginary straight pen tip line.

Another aspect of the present invention is the combination of one or more pens in a specially designed pen holder that hinders the drying out of the pen tips. Broadly, that combination comprises:

(a) a pen for drawing an even number of parallel lines for use in preparing advertising copy, said pen comprising (i) a casing having a bottom casing section, a middle casing section, and a top casing section;

(ii) a pen tip mounting section attached to the casing;

(iii) an even number of pen tips in spaced relationship attached to the pen tip mounting section and extending outwardly from the casing, the ends of the pen tips lying on an imaginary straight pen tip line; and (iv) pen locking means above the ends of the pen tips; and (b) a pen holder having a top surface and a recess in the top surface extending downward to a depth sufficient to accommodate at least part of the bottom casing section of the pen, the cross-section of the recess corresponding to and matingly engaging in close-fitting relationship the cross-section of the bottom casing section of the pen, the recess having holder locking means that cooperate with the pen locking means of the pen to form a seal that hinders the drying out of the pen tips.

The pen and pen holder combination facilitate rapid and accurate preparation of the layouts for advertising copy. Other advantages and features of the invention will be apparent from the following.

BRIEF DESCRIPTION OF THE DRAWINGS

To facilitate further discussion of the invention, the following drawings are provided in which:

FIG. 1 shows the pen and pen and holder combination of this invention in use on a desk to prepare the layout for an advertisement;

FIG. 2 shows a longitudinal cross-section of one embodiment of the pen of this invention;

FIG. 3 shows a partial longitudinal cross-section of another embodiment of the pen;

FIG. 4 is a cross-sectional view of the pen of FIG. 2 taken along line 4—4 of FIG. 2;

FIG. 5 is an end view of the pen tip mounting section of the pen;

FIG. 6 is a partial cross-sectional side elevational view of the pen and holder combination of FIG. 1;

Figures 7, 8, 9, 10, 11, 12, 13:
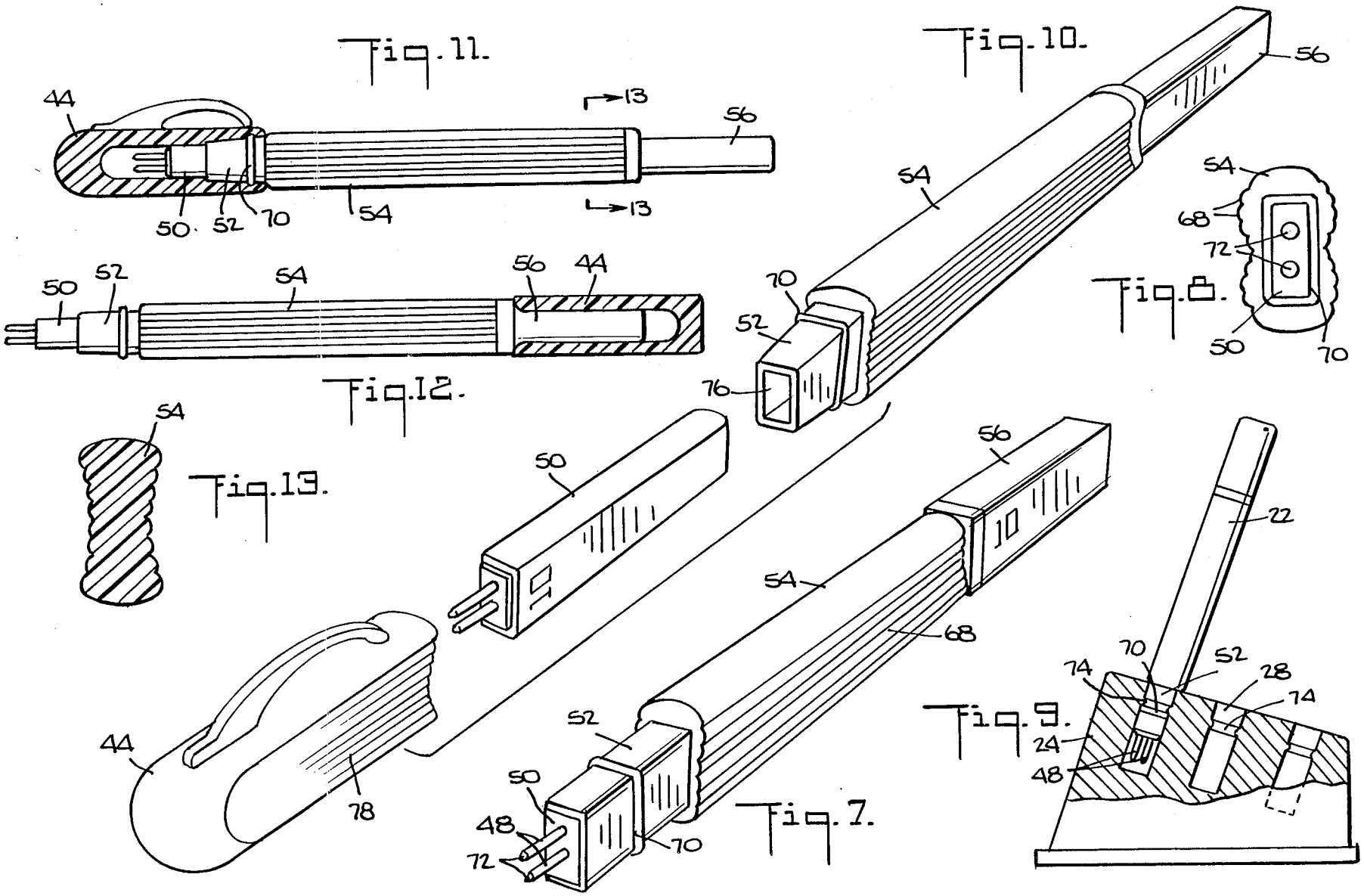
FIG. 7 is a perspective view of another embodiment of the pen.
FIG. 8 is an end view of the pen of FIG. 7.
FIG. 9 is a partial cross-sectional side elevational view of another pen and pen holder combination of this invention.
FIG. 10 is an exploded perspective view of another embodiment of the pen.
FIG. 11 is a side view of the pen of FIG. 10 showing the cap in cross-section.
FIG. 12 is a second side view of the pen of FIG. 10, but showing the cap (in cross-section) attached to the pen in a different location.
FIG. 13 is a cross-sectional view of the pen of FIG. 10 taken along line 13—13 of FIG. 11.

These drawings are provided for illustrative purposes only and should not be construed to limit the scope of the invention.

DETAILED DESCRIPTION OF THE INVENTION

In FIG. 1 pen and pen holder combination 20 rests on desk 34. Several pens 22 rest in their respective recesses 28 in pen holder 24. The recesses extend downwardly from top surface 26 of pen holder 24. Document 36 is removably fastened to the top of desk 34 by tape 38. Indicia 30 on the top ends of pen 22 and indicia 32 on the front of pen holder 24 show the size of the character font that will be indicated to the typographer by the distance between the two parallel lines produced by each of the pens. The customary unit for the size of the font is "point." Thus, a pen bearing the number "12" will produce a pair of parallel lines spaced at a distance indicating that characters from the 12-point font are to be used when the final version of the document is prepared by the typographer. Also shown in FIG. 1 on document 36 are several sets of spaced parallel lines 42 produced by means of pen 22 and T square 40. The substantially rectangular cross-sectional shape of the pen casing indicates to the user that the pen is being held in proper orientation to produce the two parallel lines.

In FIGS. 2 and 3 pen tips 48 are protected by cap 44 having clip 46. Tips 48 are mounted in pen tip mounting section 50, which contains the ink supply. The casing of the pen comprises bottom casing section 52, middle casing section 54, and top casing section 56. Cap 44 fits on the narrowed portion of bottom casing section 52. Indicia 30 located on top casing section 56 and indicia 58 located on the end of pen tip mounting section 50, indicate the point size of the pen. Line 64 indicates the length of the major axis of the cross-section of middle casing section 54.

In FIG. 4 foam or felt material 60, which contains the ink supply, is located within pen tip mounting section 50.

In FIG. 5 ends 72 of pen tips 48 are shown to lie along imaginary line 62. In a preferred embodiment the cross-section of middle casing section 54 is substantially rectangular and major axis 64 is parallel to imaginary line 62. That allows a person using the novel pen to be sure that he or she is holding the pen properly so that the desired parallel lines will be produced simultaneously as the pen is used.

In FIG. 6 bottom casing section 52 of pen 22 is seen to correspond to and matingly engage the cross-section of recess 28 in pen holder 24. Shoulders 66 at the bottom of middle casing section 54 act as stops when they hit top surface 26 to prevent further entry of the pen into the recess and consequent possible damage to pen tips 48. The snug fit of bottom casing section 52 in recess 28 helps prevent the pen tips from drying out, which would hinder their further use.

In FIG. 7 middle casing section 54 has ribs 68, which provide the user with a better grip of the pen and also help indicate the proper orientation of the pen. Pen tip mounting section 50 is contained within bottom casing section 52, and pen tips 48 have ends 72. Pen locking means 70 in the form of a rib lies on the outer circumference of bottom casing section 52.

FIG. 8 shows the cross-section of middle casing section 54 to have the shape of a FIG. 8, which is substantially rectangular in shape. The major axis of middle casing section 54 lies along the imaginary line connecting ends 72 of pen tips 48.

FIG. 9 shows how pen locking means 70 cooperates with holder locking means 74. Holder locking means 74 is a slightly narrowed section along the side walls of recess 28. Holder locking means 74 may be a narrowed wall section formed from spring steel, an elastomer, or any other resilient and deformable material. When pen 22 is pushed down into recess 28, pen locking means 70 is pushed past holder locking means 74. Pen 22 is then releasably locked in position. Such locking action may be accompanied by a positive signal to the user, such as an audible click or a sudden release of resistance as rib 70 is pushed below holder locking means 74. Locking bottom casing section 52 within recess 28 insures that the pen tips will not be exposed to circulating air, which would hasten their drying out. A variety of locking means on the pen and in the holder may be used for this purpose.

In FIG. 10 top casing section 56 is seen to be of smaller cross-section than middle casing section 54. Pen tip mounting section 50 fits within recess 76 of bottom casing section 52. The pen of this invention may be manufactured so that the entire pen is disposed of after the ink supply is exhausted or may be manufactured so that a depleted ink supply (pen tip mounting section 50) is thrown away and a new pen tip mounting section 50 with a fresh ink supply is placed within the pen. Cap 44 also has ribs 78 for aesthetic reasons and to facilitate its handling and removal.

FIG. 11 shows that bottom casing section 52 has inclined sides. The lower end of pen tip mounting section 50 extends below bottom casing section 52, which has pen locking means 70. The inner recess of cap 44 conforms to the outer surfaces of pen tip mounting section 50, bottom casing section 52, and pen locking means 70.

In FIG. 12 cap 44 has been removed from the bottom section of the pen and placed on top casing section 56 to remain there while the pen is in use. Cap 44 is replaced (as in FIG. 11) when the pen is not in use to prevent drying out of the tips.

FIG. 13 shows the cross-sectional shape of middle casing section 54 of the pen shown in FIGS. 10–12. The shape is substantially rectangular. The two longer sides of middle casing section 54 are concave and have ribs. Both of those features provide a better grip and indicate to the user that he or she is holding the pen properly to produce simultaneously the desired pair of parallel lines.

Many variations and modifications are possible. For example, the color of the casing and cap of a pen will usually be the same and will indicate the color of the ink within that pen. Usually only four colors will be used, red, green, blue, and black, because those are the colors typically used in four-color printing for magazines, newspapers, etc. A single pen may also have more than one pair of tips. For example, a pen could have two pairs of two tips to enable a layout editor to draw two sets of parallel lines at the same time. The space between the two middle tips would be greater than the space between the first and second and third and fourth tips so that the parallel line sets would be spaced apart properly. The tips may be provided in different diameters so that the lines produced can be of different thicknesses. Other modifications and variations will be apparent to those skilled in the art and the claims are intended to cover all such modifications and variations that fall within the true spirit and scope of this invention.

I claim:

1. In combination, (a) a plurality of pens for drawing one or more sets of two parallel lines on a layout document used in preparing a printed document, the distance between the two lines of each set indicating the type size of the text to appear in the printed document, each pen comprising:

(i) a casing having a bottom casing section, a middle casing section, and a top casing section;

(ii) a pen tip mounting section attached to the casing;

(iii) not less than or more than two pen tips, the tips being in spaced relationship attached to the pen tip mounting section and extending downward from the bottom casing section, the ends of the pen tips lying on an imaginary straight pen tip line and the distance between the pen tips indicating the type size of the text to appear in the printed document; and (iv) pen locking means above the ends of the pen tips; and (b) a pen holder having a top surface and a plurality of recesses in the top surface, each recess extending downward to a depth sufficient to accommodate the pen tips and at least part of the bottom casing section of a corresponding pen of the plurality of pens, the cross-section of each recess corresponding to and matingly engaged in close-fitting relationship the cross-section of the bottom casing section of its corresponding pen, each recess having holder locking means that cooperate with the pen locking means of the corresponding pen to form a seal that hinders the drying out of the pen tips;

wherein (i) at least two of the pens have different spacing between their respective pen tips, (ii) each of the pens bears indicia related to the spacing of its pen tips, and (iii) the pen holder bears indicia corresponding to the indicia on the pens to facilitate proper placement of the pens in the pen holder.

2. The combination of claim 1 wherein the middle casing section of each pen has an approximately rectangular cross-section.

3. The combination of claim 2 wherein the major axis of the cross-section of the middle casing section of the pen is substantially parallel to the pen tip line.

4. The combination of claim 1 wherein at least part of the pen tip mounting section is removably contained within the bottom casing section of the pen.

* * * * *